US005367853A

United States Patent [19]

Bryan

[11] Patent Number: 5,367,853

[45] Date of Patent: Nov. 29, 1994

[54] PREFABRICATED DECK SYSTEM

[76] Inventor: Robert Bryan, 2269 Lakeshore Blvd. West, Unit #2206, Etobicoke, Ontario, Canada, M8V 3X6

[21] Appl. No.: 26,598

[22] Filed: Mar. 5, 1993

Related U.S. Application Data

[63] Continuation-in-part of Ser. No. 972,929, Nov. 6, 1992.

[51] Int. Cl.[5] ..... E04B 1/38

[52] U.S. Cl. ..... 52/702; 52/289

[58] Field of Search ..... 52/702–704, 52/712, 289; 403/232.1

[56] References Cited

U.S. PATENT DOCUMENTS

| | | | |
|---|---|---|---|
| 666,918 | 1/1901 | Butz . | |
| 874,514 | 12/1907 | Lindow | 403 X/232.1 |
| 1,406,723 | 2/1922 | Caldwell | 403/232.1 |
| 1,692,351 | 11/1928 | Ropp | 52/702 |
| 2,500,636 | 3/1950 | Isakson | 52/702 |
| 3,036,347 | 5/1962 | Findleton | 52/702 |
| 3,300,936 | 1/1967 | Travaglia | 52/477 |
| 3,365,222 | 1/1968 | Polyak | 52 X/272 |
| 3,504,472 | 4/1970 | Clement | 52/477 |
| 3,513,786 | 5/1970 | Kellogg | 52 X/585 |
| 3,579,941 | 5/1971 | Tibbals | 52/384 |
| 3,601,428 | 8/1971 | Gilb | 403/232.1 |
| 3,633,950 | 1/1972 | Gilb | 52/289 |
| 3,703,304 | 11/1972 | Losee | 403 X/232.1 |
| 3,752,512 | 8/1973 | Gilb | 287/20.94 |
| 3,837,135 | 9/1974 | Zachman | 52/702 |
| 4,028,858 | 6/1977 | Rehbein | 52/384 |
| 4,051,639 | 10/1977 | Lombardi | 52/64 |
| 4,124,962 | 11/1978 | Lancelot | 403 X/232.1 |
| 4,353,664 | 10/1982 | Gilb | 52 X/702 |
| 4,411,548 | 10/1983 | Tschan | 52 X/289 |
| 4,422,792 | 12/1983 | Gilb | 52 X/702 |
| 4,480,941 | 11/1984 | Gilb | 52 X/650 |
| 4,527,933 | 7/1985 | Karhumaki | 52 X/712 |
| 4,575,982 | 3/1986 | Wenger | 52/509 |
| 4,628,645 | 12/1986 | Tafelski, Jr. | 52/169.1 |
| 4,802,786 | 2/1989 | Yauger | 52 X/702 |
| 4,920,725 | 5/1990 | Gore | 52/702 |
| 4,965,980 | 10/1990 | Leavens | 52 X/702 |
| 4,982,548 | 1/1991 | Abbey | 52/702 |
| 4,999,964 | 5/1991 | Taylor | 52/477 |
| 5,104,252 | 4/1992 | Colonias et al. | 403/232.1 |

*Primary Examiner*—Carl D. Friedman
*Assistant Examiner*—Beth A. Aubrey
*Attorney, Agent, or Firm*—Cushman, Darby & Cushman

[57] ABSTRACT

A suspended deck system using prefabricated deck block modules incorporates a prefabricated suspended platform. The platform comprises joist members within a frame, the joists being spaced in accordance with the size of the deck blocks, and having lateral cross braces suspended therebetween to complete the block support arrangement. Cross brace brackets are provided by means of which the cross braces are suspended from, and nailed to the platform joists, each bracket having an upstanding spacer member with an inturned toe, to serve as a corner locator for the respective deck block. The brackets may also incorporate upstanding prongs that penetrate and secure the deck blocks when located to the spacer members, and hammered down in impaled relation onto the prongs. The brackets also are provided with internal nailing guide chutes, for positioning and seating the securing nails when driven home, to anchor both bracket and cross brace to the flank of the joist.

12 Claims, 7 Drawing Sheets

PREFABRICATED DECK SYSTEM

TECHNICAL FIELD

This invention is directed to a prefabricated deck system, and in particular to a prefabricated substructure incorporating a suspension bracket, and is a continuation-in-part of pending application Ser. No. 07/972,929, filed Nov. 6, 1992.

BACKGROUND ART

The provision of a raised wooden outside deck is commonplace in a great many North American homes, frequently being combined with sliding patio doors that give access to the deck or patio.

Such decks are usually built of lumber, having a supporting frame and substructure, including joists and headers, to which a decking of solid board lumber is nailed. Many decks are subject to severe climatic conditions that cause shrinking and working of the boards, leading to cracking of the boards and partial drawing of the nails. This is both unsightly, and a safety hazard, while the nails can rust and cause discoloration.

Such decks are frequently painted, for cosmetic purposes, the presence of so many nails making a natural wood finish impractical.

In a painted deck of continuous, nailed-down boards the nature of the decking and the usually confined substructure virtually precludes ready painting of the under surfaces thereof. Thus the upward passage of moisture through the boards tends to lift the paint, with consequent short life term.

A form of wooden deck tread or "tile" has previously been developed, having a nail-less structure, in which a wooden surface of deck tread units is laid upon concrete sub-flooring, such as balconies and the like, in the manner of laying tiles.

The deck tread units comprise lateral tread bars, the ends of which are threaded upon a rope-like tying element such as a hollow plastic hose. Each end of the tread bars is drilled, laterally, to provide an aperture into which the tying element is inserted. This construction is time consuming and expensive to machine, particularly in the drilling of the end apertures, while the insertion of the flexible tying elements is laborious, time consuming and difficult. Such tread units are unsuited for use with a suspended deck system, due to the undue skewing flexibility, and difficulty in maintaining dimensional standardization.

Certain other somewhat less relevant aspects of modular decking or patio structures are to be found in U.S. Pat. Nos.

3,300,936 January 1967, Travaglia
4,028,858 June 1977, Rehbein
4,628,645 December 1986, Tafelski
4,999,964 March 1991, Taylor Certain characteristics similar to the subject support bracket that forms a part of the present invention may be found in U.S. Pat. Nos. 666,918; 4,920,725; and 5,104,252.

DISCLOSURE OF THE INVENTION

The present invention provides a prefabricated deck block for surfacing a deck. The subject deck block comprises a series of lateral bars in closely spaced, mutually parallel relation, having common tie members splined in place at each end of each bar.

The subject deck blocks may be laid upon an existing support surface, or they may be integrated as a suspended deck surface into a pre-fabricated deck substructure having a series of surface recesses into which the individual blocks are laid in close, flush fitting relation with the deck supporting members of the sub-structure.

Each lateral bar of each deck block has a narrow spline recess traversing the end of the bar, into which a suitable spline member is inserted, so as to secure the bars in mutually spaced, parallel relation. A steel staple driven through one face of the lateral bar and into the spline member in locking engagement therewith provides low cost, unobtrusive securement of the block elements.

The spline recesses are readily and rapidly formed into the ends of the lateral bars as part of the manufacturing process, by means of a saw cut, or the like. The adoption of thin, wide spline members of wood imparts lateral rigidity to the block, to retain its shape, while permitting accommodating longitudinal flexure of the block.

A particular advantage afforded by the structure of the present invention is the facility with which the decking blocks may be lifted and reversed. This capability makes possible the painting of the reverse face of the decking blocks, thereby vapour-proofing and waterproofing the blocks against upward penetration of water vapour from below. This, in turn prolongs the service life of the painted block upper surfaces, which are otherwise most susceptible to degradation due to the upward penetration of water vapour, which lifts the top paint.

The deck substructure, which is preferably pre-fabricated, comprises a deep section main frame of joists and headers, with cross braces of shallower section. In one embodiment the upper edges of all the substructure members may be rabetted.

In a second deck substructure embodiment having a deep section main frame of joists and headers, the cross braces of shallower section are carried upon special purpose suspension brackets. The brackets have upstanding corner web portions that serve to locate the corners of the prefabricated deck blocks. A pair of such brackets secured in back-to-back relation on a joist can serve to locate the adjacent corners of four such deck blocks in mutually positioned relation. The suspension brackets may also have upstanding prongs, onto which the deck blocks are impaled, thereby securing the deck blocks to the deck substructure from below. This construction obviates rabetting of the upper edges of the substructure members, while permitting virtually back-to-back spacing of the deck blocks, which may be spaced from each other by merely the double thickness of the bracket upstanding corner web portions.

In a rabetted substructure embodiment the rabetted longitudinal edges of the joists, headers and cross braces are preferably rabetted to the depth of the deck blocks. Thus, when the deck sub-structure is assembled a series of adjacent square receses are provided, into which the deck blocks fit quite precisely, without requirement of nailing, to give a flush fitting, nail-free deck floor. Generally the deck blocks are oriented with the staples located on the underside. The use of deck blocks of square plan enables the blocks to be oriented in a parquet arrangement, with the lateral bars of alternate blocks arranged mutually at right angles, i.e., north-/south or east/west, figuratively speaking.

The attachment of deck sub-structure cross braces generally includes a recessed lower portion of each cross-brace, to form a projecting tongue, supported upon the rabetted joist, or header.

In a further alternative embodiment the deck substructure may be left unrecessed, with the reverse face of the deck blocks having the edges thereof rabetted in order to provide a locating fit with the deck substructure.

In addition to securely locating the deck blocks, the provision of rabetted corners to the blocks or to the deck substructure tends to stabilize the joists, members and cross-braces of the substructure against warpage.

The alternative bracket supported cross brace embodiment provides upstanding spacer members as the lateral restraint barrier for securing the deck blocks. Such barrier may be alternatively provided by centrally grooving the top surfaces of the substructure with a narrow groove into which a suitable restraint means such as steel strapping may be edge-mounted. These provisions then serve to keep the deck blocks effectively centered on the support structure and to ensure that the deck blocks cannot drop, unsupported, between the supporting members.

As a further embodiment the deck blocks may be made asymetrical, by off setting the spline recesses and extending the splines outside the block ends by a predetermined amount. This then facilitates the assembly of the blocks in mutual spacing relation, such that wood screws, preferably of the Roberston type may be inserted through two of the overlapped extended splines, and into the supporting sub-frame member, in lateral restraining relation with the deck blocks.

The provision of cross brace support brackets having upstanding spacer members to form locating corners, or the provision of longitudinal slots in top surfaces of the joists and other members of the sub-frame, to receive the lateral restraint strips, is both cost effective and minimizes the reduction in strength of the respective sub-frame members.

Assembly of the respective sub-structure components of the suspended deck preferably utilizes plain butt joints secured in flush abutting relation by way of ribbed dowell pins.

Such pins, made of engineering plastic, are very strong, and when driven home into a suitably predrilled wooden member, resist dis-assembly to the point of requiring to be cut free.

The present system utilizes precision jig pre-drilling of the respective sub-structure members, to assure standardized interchangeability of the members.

It is contemplated that the adoption of longitudinally flexible spline members such as steel strapping with suitable spacing of the lateral bars will permit the provision and use of long lengths of prefabricated decking which may be rolled up for transportation.

The sub-structure cross braces may be suitably positioned, height-wise to accommodate such elongated decking units. One such arrangement may include spacing of the deck block lateral bars to accept the upward projection of the top edge portions of the cross brace upstanding spacer members in locating relation between adjacent pairs of lateral bars of the decking unit.

Alternatively, the lesser required number of cross braces may be fully recessed below the decking unit cross bars, on their respective support brackets.

Positive attachment, of deck blocks to the sub-structure may be effected by impaling the deck blocks upon the upstanding prongs of the cross brace support brackets.

The adoption of cross brace support brackets wherein the support brackets incorporate upstanding spacer members serve to locate the corners of the respective prefabricated deck blocks, which can greatly simplify the block locating provisions of the deck substructure. Thus, the rabetting of the deck substructure can be eliminated, and simple butt joints adopted for the cross braces, while the precision drilling for locating dowels for the cross brace is eliminated.

The further provision of upstanding prongs, struck out of the support brackets enables the impalement of the deck blocks, thereby providing concealed attachment of the blocks. The recesses provided by the prong strike-outs may serve as nailing holes for securing the bracket top flange to the top face of the joist.

In addition, mutually off-set nailing channels deformed from the sides of the bracket provide a solid seat for the nail heads of toe nails driven therethrough, and may serve as directional guides in driving the nails through one or more nailing windows located in the rear face of the bracket, to penetrate into the side of the supporting joist.

Thus, the present invention further provides a cross brace support bracket, for use in attaching a cross brace of predetermined cross-sectional form to a support joist, the cross brace bracket having a top flange for mounting the bracket in suspended relation from a top surface portion of the joist; a bracket cup portion suspended from the top flange, having a back portion extending substantially normally from the top flange and having a pair of side flanges and a bottom portion forming the cup, each extending substantially normally from the back portion, the bottom portion interconnecting the two side flanges and extending normally thereto as a receptacle for the entry and support of one end of a cross brace in supported relation therein; the top flange having an upstanding spacer portion extending normally upwardly therefrom and including an inturned toe portion extending therefrom at right angles, and in overlying relation with a portion of the top flange of the bracket.

The aforesaid top flange may have at least one upstanding prong projecting upwardly therefrom.

This prong may be substantially planar, extending substantially parallel with the spacer toe portion.

The present invention further provides the aforementioned bracket in combination with a joist and cross brace, and forming a portion of a platform, the platform including a decking of deck blocks, the bracket top flange spacer portion constituting a corner receptacle to receive the deck block in positioned relation therewith.

In general, the decking system according to the present invention is intended for assembly requiring primarily a suitable hammer.

In addition to use as decks, the present system also lends itself to pathways and for docks, the deck blocks in some instances being retrievable for off-season storage.

Seasonal repainting also is greatly facilitated.

BRIEF DESCRIPTION OF DRAWINGS

Certain embodiments of the invention are described by way of example, without limitation of the invention thereto, reference being made to the accompanying drawings, wherein.

BEST MODE OF CARRYING OUT THE INVENTION

Figure 1:
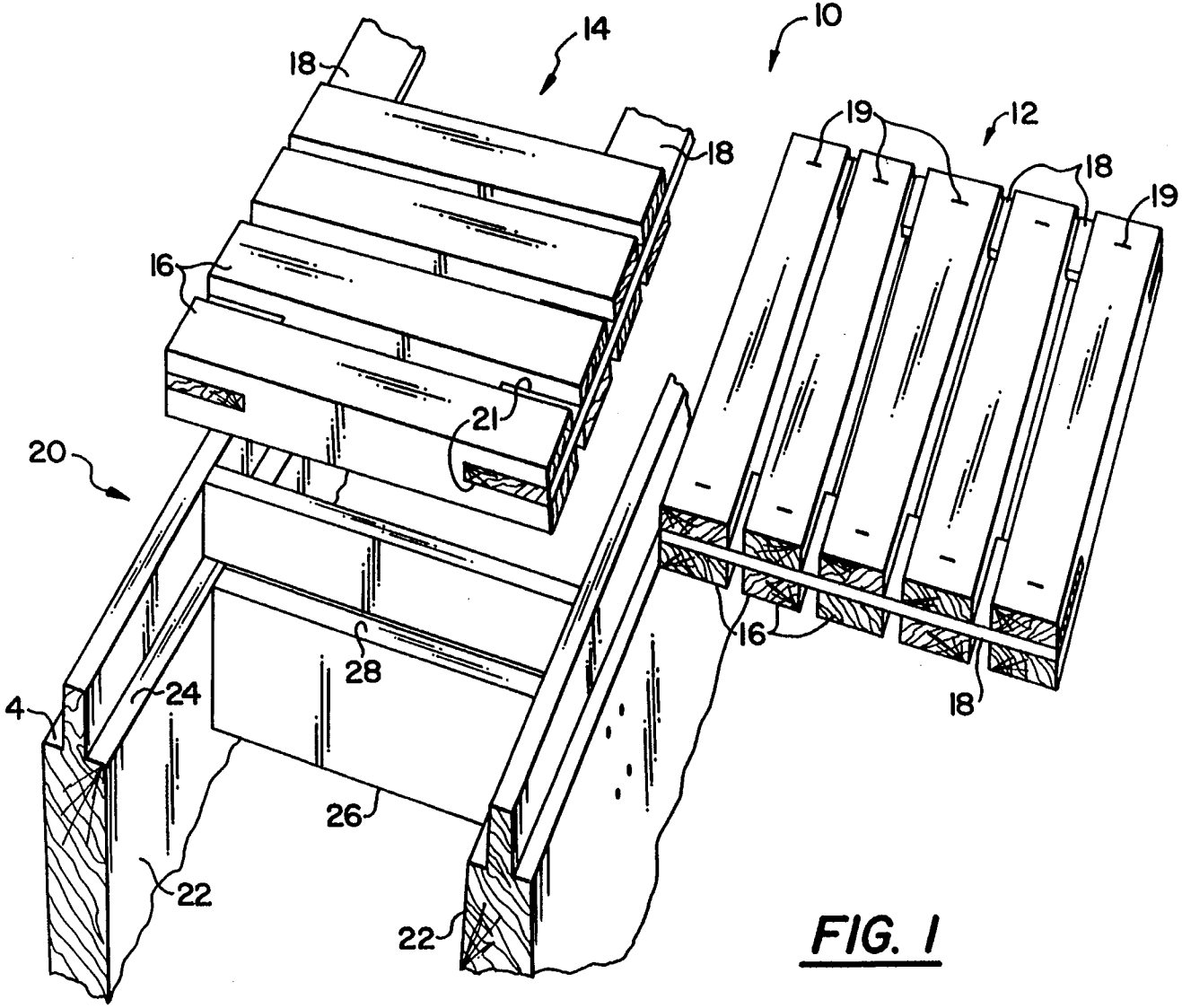
FIG. 1 is a perspective view from above showing a pair of adjacent deck blocks, and a typical portion of deck sub-structure in spaced relation therebeneath.

Referring to FIG. 1 a portion of deck structure 10 comprises deck block 12, and a portion of block 14, the blocks being illustrated as being of square planform. Each deck block 12, 14 comprises lateral wooden bars 16 of substantially square section, with eased corner edges, and a slender wood spline 18 inserted in close fitting relation in the slotted ends of bars 16. Elongated steel staples 19, shown in the reverse face of block 12, penetrate and secure the wood spline 18. Each intermediate bar 16, being solely end supported, is in essence a beam.

The staples 19 are effectively flush with the undersurface of the block 12, holding the inner edge of the spline 8 firmly positioned against the inner edge of the respective slots 21 within which it is seated, thereby stabilizing the block against undue skew.

The blocks retain a certain degree of stiff skewability, to facilitate accommodation to the deck substructure.

In one embodiment the bars 16 are of 2-inch by 2-inch (nominal) section, the spline 18 of 2-inch wide by 3/16 inch thick softwood. The blocks 12, 14 are preferably made up in 18-inch by 18-inch or 24-inch by 24-inch units, depending upon intended use, users preference and local load rating bylaws.

Figure 9:
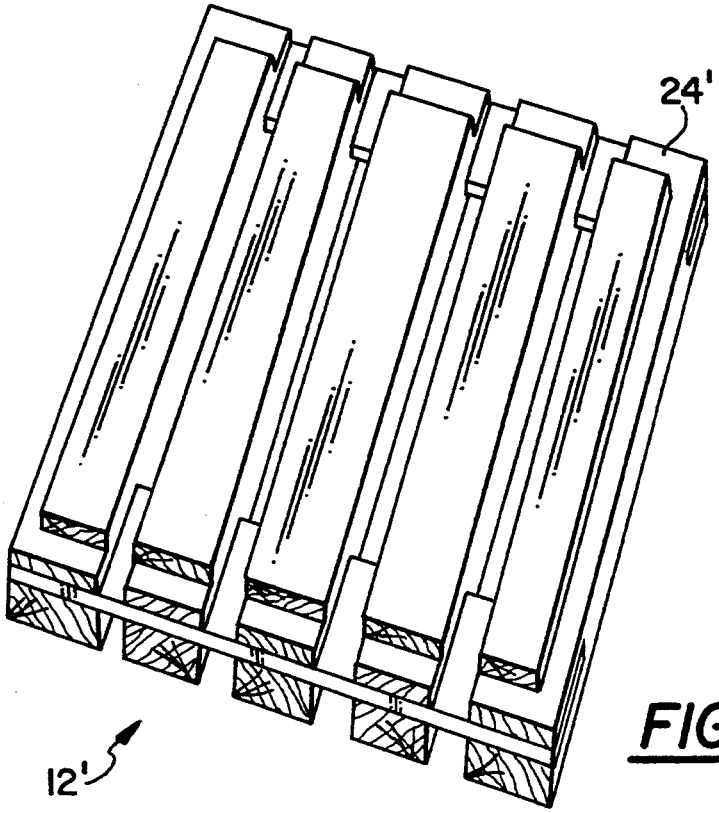
FIG. 9 is an inverted plain view of a rabetted deck block.

Referring to FIG. 9, the block embodiment 12′ has a peripheral recess or rabet 24′ about the periphery of its reverse face, usually machined after assembly of the blocks 12′.

Figure 2:
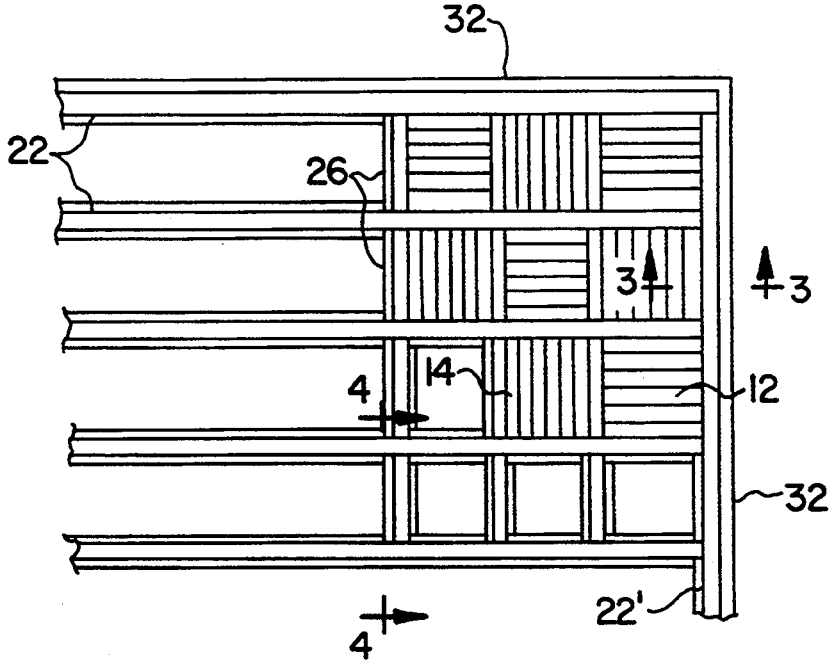
FIG. 2 is a plan view of a portion of a deck substructure with some deck blocks inserted in parquet-block arrangement therein.
Figure 3:
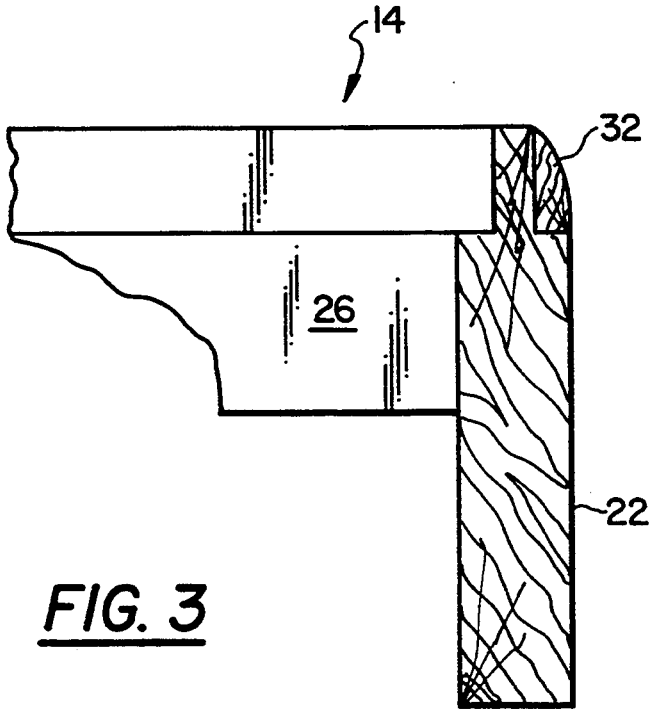
FIG. 3 is a part-section taken at 3—3 of FIG. 2.
Figure 4:
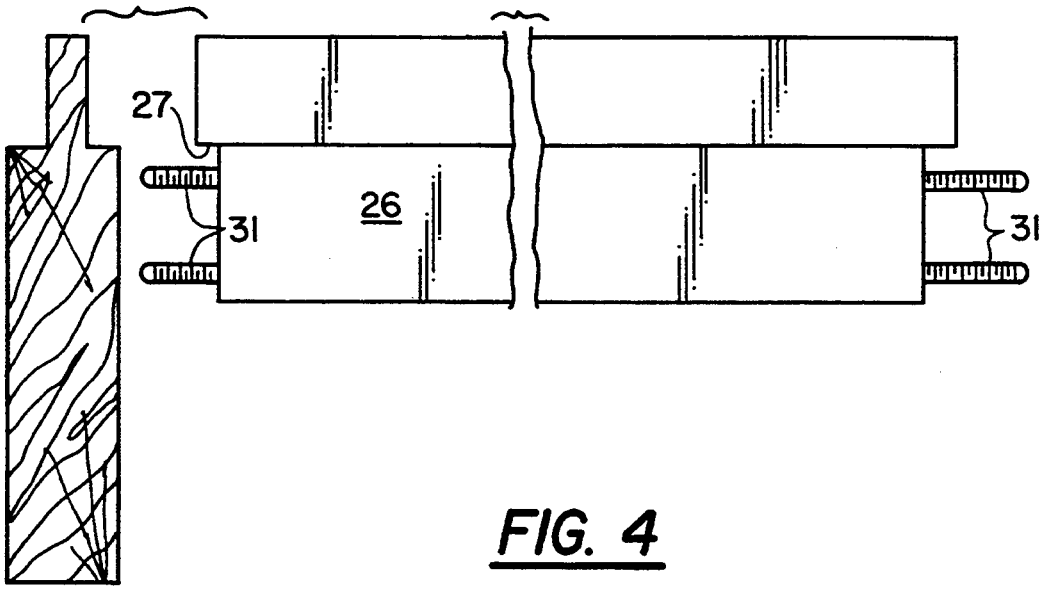
FIG. 4 is a part-section taken at 4—4 of FIG. 2.

Referring also to FIGS. 2, 3, and 4 the underlying substructure 20 comprises headers 22′ supporting joists 22, both headers and joists having rabetts 24 along the top longitudinal edge corners thereof, the rabetts 24 normally being recessed to the depth of the blocks 12, 14. Cross-brace members 26 have similar rabetts 28.

In the preferred embodiment the joists each have one end thereof notched, leaving the upper tongue portion 27 protruding by the extent of the rabett 24 of the header upon which the joist rests, and to which it is pinned, by way of drive pins 37.

In the case of the transverse closing header member 22′ to which the ends of the joists 22 are attached, this member has the upper longitudinal edges thereof rabetted on both sides, the outer rabett receiving a shaped trim piece 32 which may be used to frame the exposed joist edges of the deck.

The substructure used in conjunction with rabetted blocks 12′ may be of non-rabetted joists, headers and cross-braces, to receive the rabetted blocks 12′ in fitting relation therein.

Figure 5:
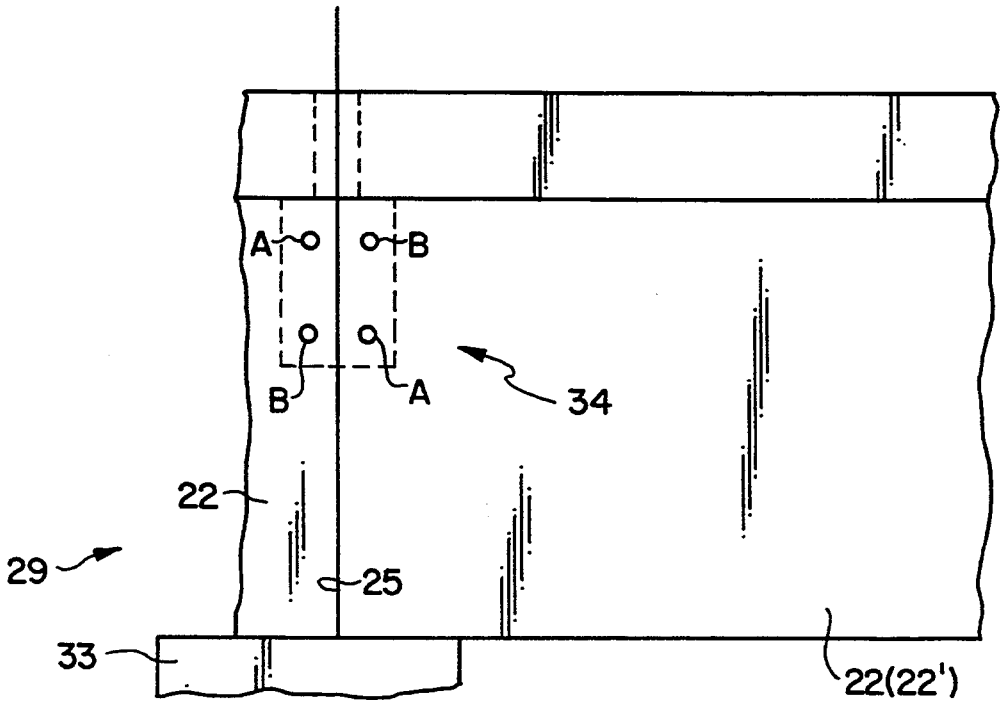
FIG. 5 is a side elevation of a sub-frame butt joint.

Referring to FIG. 5, a joist arrangement 29 may comprise the "inner" (un-notched) end of joist 22, supported upon a pier 33 in abutting relation with the end of a header 22′ which is normally un-notched, or the "inner" (un-notched) end of a joist 22.

A precision drilled pattern of dowel holes 34 consisting of two adjacent pairs of holes A, B is drilled adjacent the ends of the respective joist and/or header members. The attachment of a cross-brace member 26 by insertion of the respective drive pins 31 serves to maintain the interface 25 in joined relation.

Figure 7:
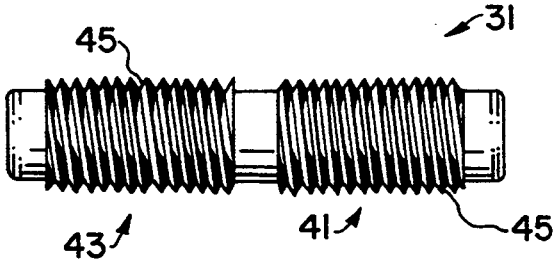
FIG. 7 is a side view of a ribbed dowel pin.

The drive pins 31 (FIG. 7) are of nylon or other higher strength engineering plastic. The pins 31 are double ended, each end 41, 43 having a series of inwardly tapered annular ribs 45. Using a precisely undersized drill to drill dowel holes 34, each pin 31 may be readily positioned, and driven home to half its length in anchored relation within a respective dowel hole 34.

Such is the anchoring effect of the multiple resilient ribs 45, the pins 31 are permanently anchored in their holes and generally are not withdrawable.

Figure 6:
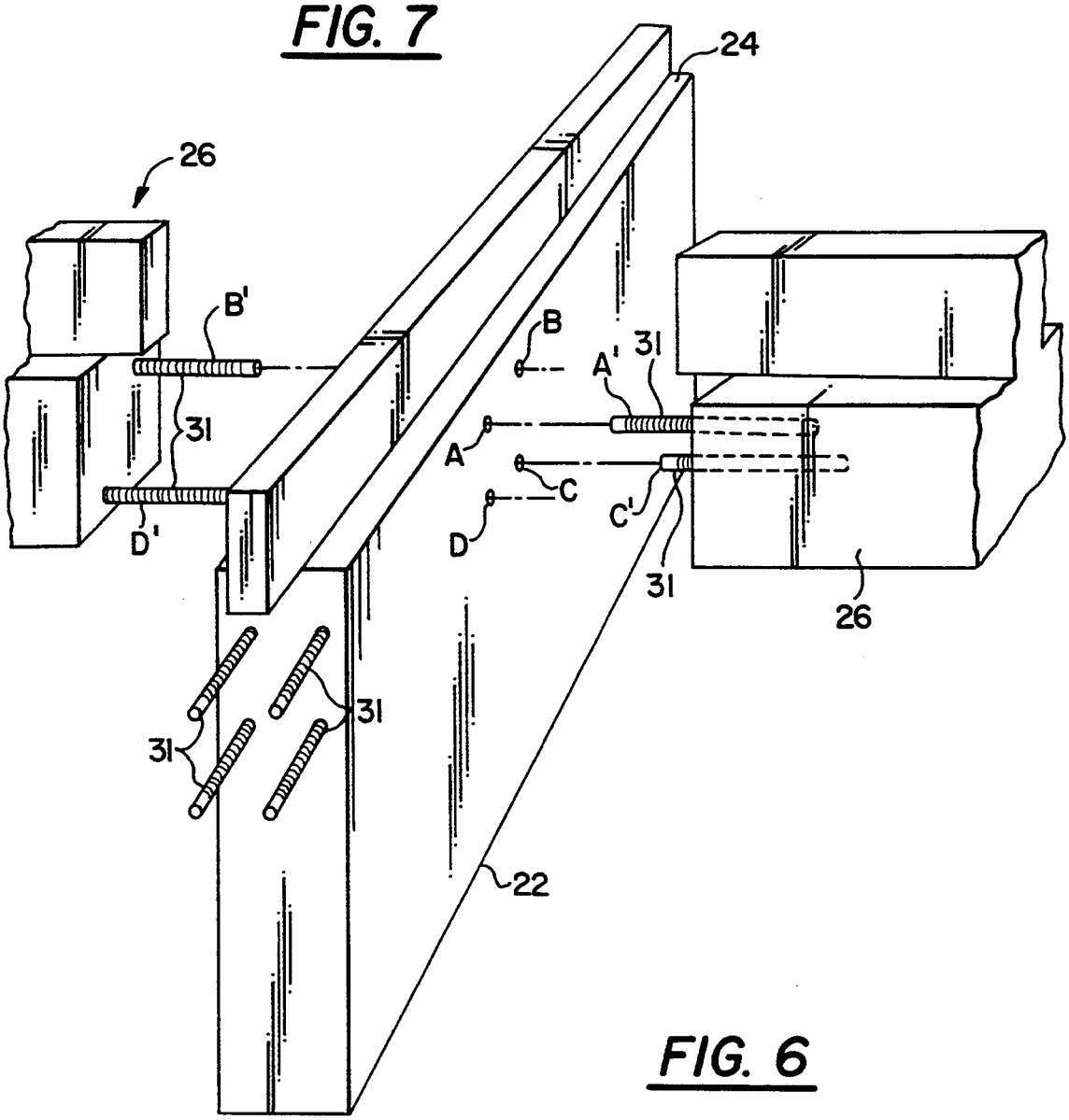
FIG. 6 is a perspective end view in exploded relation showing cross-brace members backing to a joist.
Figure 8:
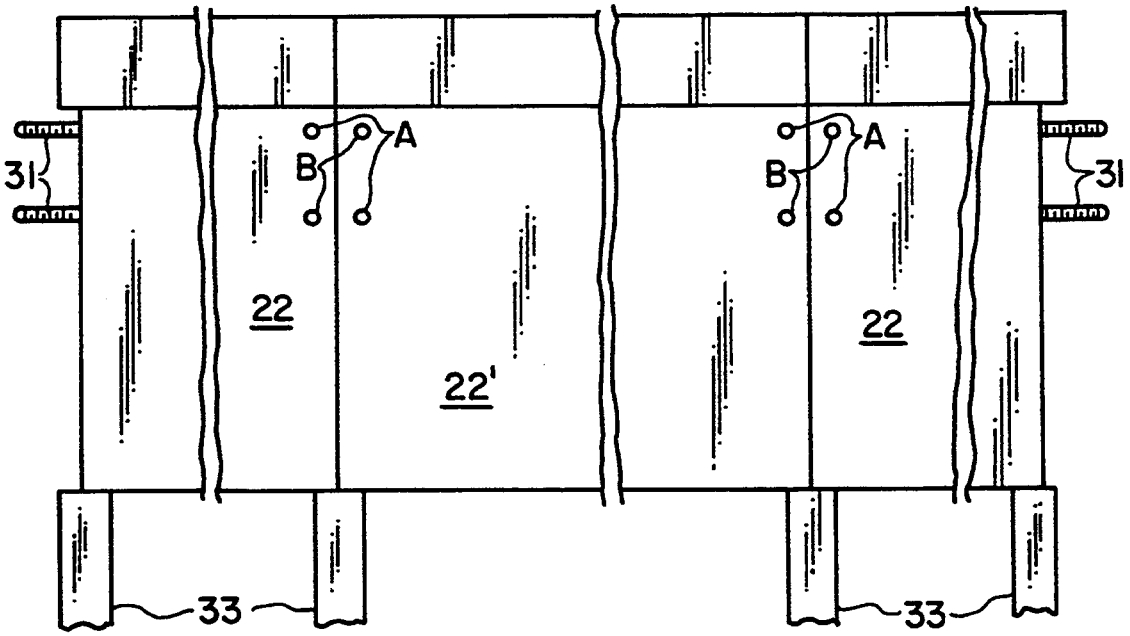
FIG. 8 is a side view of a sub-frame joist combination.

Referring to FIG. 6, a joist 22 is shown having a cross-brace 26 to be inserted from the left and a second cross-brace 26 to be inserted from the right.

The drive pins 31, nominated B′ and D′, for the left hand insertion will occupy dowel holes B and D, and extend through the thickness of joist 22. The drive pins 31 nominated A′, C′ will occupy dowel holes A and C and also extend through the width of joist 22.

The adoption of this system, having pre-drilled dowel holes, with drive pins 31 mounted on the ends of the cross-braces 26 provides a support structure that is easily assembled, and requiring the use only of a hammer.

Figure 10:
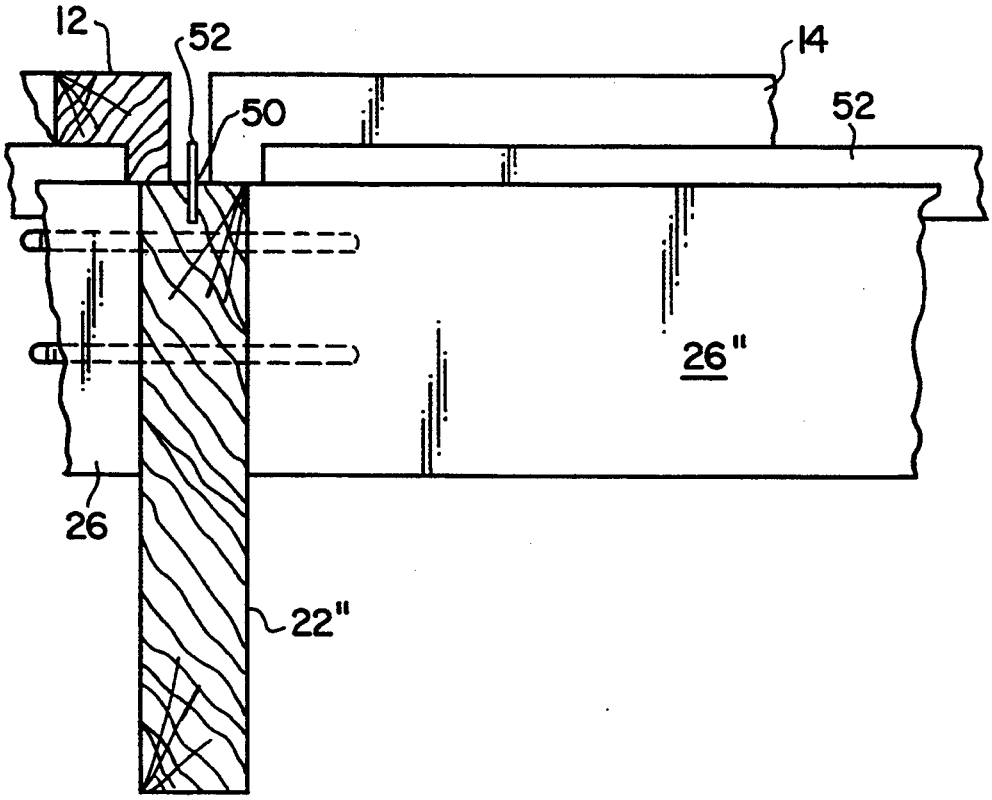
FIG. 10 is an end view of an arrangement incorporating lateral restraint strips.

Referring to FIG. 10, the joist member 22″ is shown in cross-section, having a narrow slot 50 centered longitudinally therein, with a lateral restraining piece 52 secured therein, in the form of a stiff steel or other strip. The cross-braces 26″ that are shown pegged to the joist 22″ also are shown having central slots into which the restraining strips 52 are secured.

The deck block 12 and adjacent deck block 14 are positioned in a "parquet" arrangement.

Figure 11:
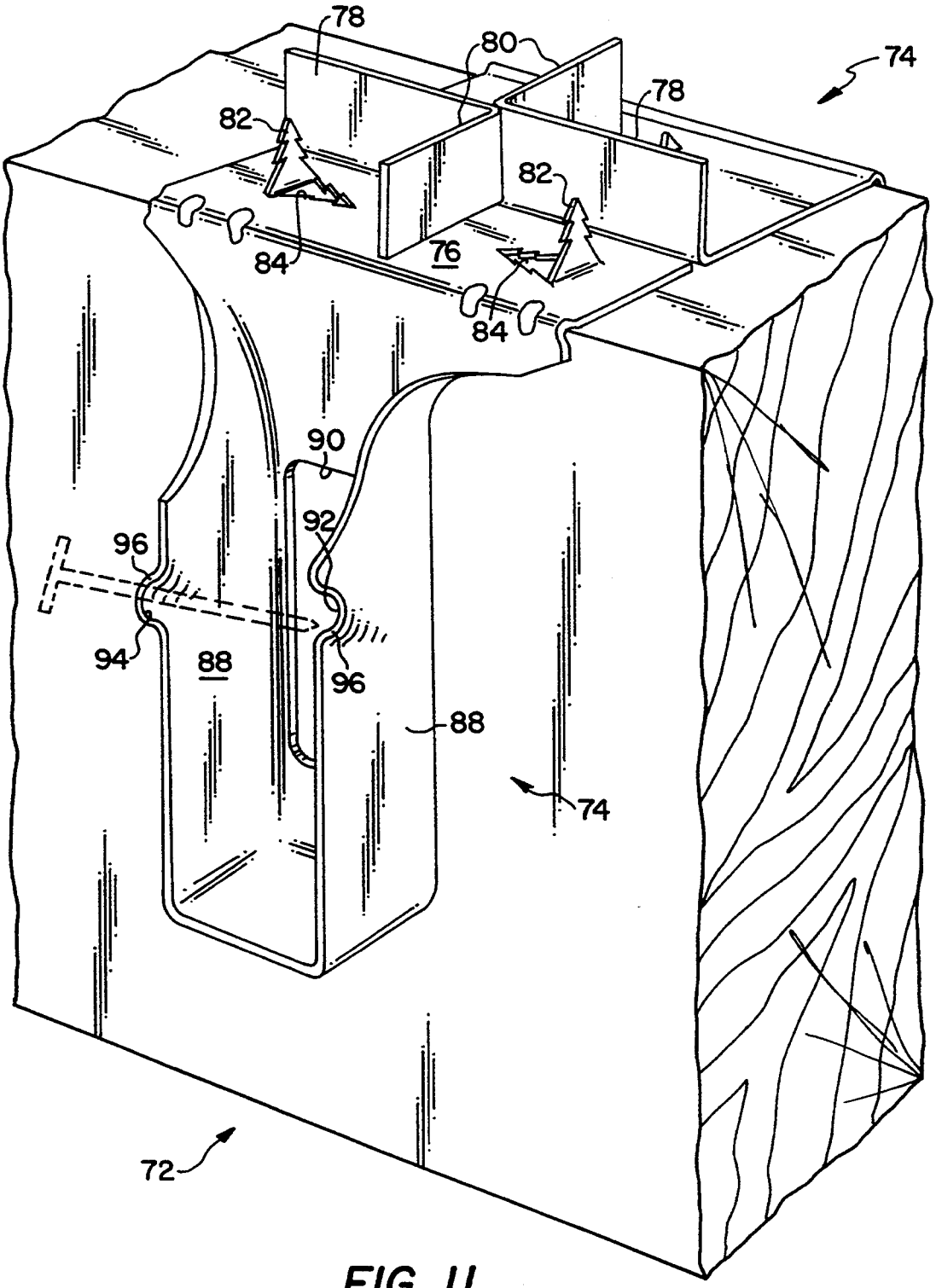
FIG. 11 is a perspective view showing a portion of deck substructure, with a joist having a pair of cross brace brackets mounted thereon.

In FIG. 11, a plain (i.e. non rabetted), joist 72 has a pair of cross brace support brackets 74, 74 mounted in back-to-back relation thereon. Each bracket 74 has a top flange 76 with an upstanding spacer flange 78. The spacer flange 78 has an inturned toe portion 80, the portions 78, 80 forming a corner guide into which a corner of one of the deck blocks 12, or 14 may be fitted, in cooperation with the like spacer flange 78 on an adjacent joist (not shown).

The fir-tree shaped prongs 82, which are struck out of the top flange 76 each engages a respective corner of a pair of adjoining deck blocks, in impaling relation therewith, when the blocks are located by spacer flange 78 and toe 80, and are then driven home in impaled, anchored relation.

Thus, as shown in FIG. 11, the adjacent corners of four deck blocks may be precisely located in mutually spaced adjoining relation, by way of two brackets 74.

The fir-tree apertures 84 in the top flange 76 may serve as nailing holes by which the brackets 74 may be secured, by nailing therethrough to the joist.

The side flanges 88 of the bracket 74 each has an externally offset nailing passage 92, 94 extending therethrough provided by a radiused upset, the top edge 96 thereof forming a semi-circular seat to receive the head of a toe-nail in seated relation thereon. The two nailing passages 92, 94 are mutually vertically offset, such that nails driven therethrough are misaligned, so as not to interfere one with the other, while being driven within a nailing aperture 90 located in the back flange of the bracket. With a cross brace in stalled in the bracket cup, toe nails located in the nailing passages are driven home, through the corners of the cross brace and within the boundary of the nailing aperture 90, into the supporting joist.

In both embodiments the deck system sub-structure is made up of a main frame of joists and headers supported upon piers or suitable posts or other footings, with cross-braces carried between the joists.

The use of sub-structure members of 6-foot and 8-foot members, usually comprising 6-foot joists and 8-foot headers.

In the case of the plain deck block embodiment the joists are preferably notched at one end, and the headers are un-notched.

The selection of 6 and 8-foot spans for the sub-structure main members then affords ready make-up of a range of deck sizes.

Thus typical deck sizes, (in fact) are:

| | | |
|---|---|---|
| 12 × 14 | 14 × 16 | 16 × 16 |
| 12 × 16 | 14 × 18 | 16 × 18 |
| 12 × 18 | 14 × 20 | 16 × 20 |
| 12 × 20, etc. | 14 × 22, etc. | 16 × 22, etc. |

The system thus makes possible an extremely wide range of pre-fabricated decks, using a minimum variety of components, namely 6-foot joists, 8-foot headers and cross-braces.

The only cutting that may be required of an erector, for certain sizes of deck, is the removal of some of the joist end tongues, by a simple single cut, in the case of the plain deck block embodiment.

INDUSTRIAL APPLICABILITY

Module blocks of square and also elongated planform, used on existing supports, or on a pre-fabricated support structure have wide applicability for replacement flooring and for new suspended structures, including walks and docks. Use of special support brackets can simplify the support structure.

What I claim is:

1. A cross brace support bracket for use in attaching a cross brace of predetermined cross sectional form to a supporting joist, said support bracket having a top flange, for mounting said bracket in suspended relation from a top surface portion of a joist; a bracket cup portion suspended from said top flange, having a back portion extending substantially normally from said top flange and having a pair of side flanges and a bottom portion each extending substantially normally from said back portion, said bottom portion interconnecting said side flanges and extending normally thereto, to form a receptacle for the support of one end of a cross brace therein;

2. The support bracket as set forth in claim 1, said top flange having at least one upstanding prong projecting upwardly therefrom.

3. The support bracket as set forth in claim 2, said upstanding prong being substantially planar and extending substantially parallel with said inturned toe portion.

4. The support bracket as set forth in claim 3, wherein said prong is pointed.

5. The support bracket as set forth in claim 4, wherein said prong is of substantially fir-tree shape.

6. The support bracket as set forth in claim 2, wherein said prong is struck out from said top flange, an aperture thus formed constituting a nailing aperture for receiving therein a nail in securing relation between said top flange and a joist.

7. The support bracket as set forth in claim 1, said bracket back portion having an aperture therein for the passage of securing nails therethrough.

8. The support bracket as set forth in claim 1, said side flanges each having an inclined nailing channel defined therein, each nailing channel having a continuous, semi-circular rim portion defining a nailing seat, in use to receive a nail head in seated relation thereagainst.

9. The support bracket as set forth in claim 11, said top flange having a width slightly less than half the width of said joist, whereby two said brackets may be mounted upon said joist in back-to-back relation, to receive two said cross braces in secured, back-to-back relation on opposite sides of said joist, said spacer portions locating corners of each of four individual deck blocks in close spaced, adjacent relation.

10. The support bracket as set forth in claim 8, said nailing channels being mutually arranged in laterally spaced apart, vertically offset relation.

11. The support bracket as set forth in claim 1, in combination with a joist and a cross brace, and a plurality of modular deck blocks, corners of a plurality of said blocks being accommodated by said upstanding spacer portion.

12. The support bracket as set forth in claim 2, in combination with a joist and a cross brace, and a plurality of modular deck blocks, said prong engaging a said deck block in impaled relation thereon.

* * * * *